US011466344B2

(12) United States Patent
Hawk et al.

(10) Patent No.: US 11,466,344 B2
(45) Date of Patent: Oct. 11, 2022

(54) HIGH-PERFORMANCE CORROSION-RESISTANT HIGH-ENTROPY ALLOYS

(71) Applicant: Energy, United States Department of, Washington, DC (US)

(72) Inventors: Jeffrey A. Hawk, Corvallis, OR (US); Paul D. Jablonski, Salem, OR (US); Malgorzata Ziomek-Moroz, Albany, OR (US); Joseph H. Tylczak, Albany, OR (US); Michael C. Gao, Albany, OR (US); Alvaro A. Rodriguez, Oklahoma City, OK (US)

(73) Assignee: Energy, United States Department of, Washington, DC (US)

( * ) Notice: Subject to any disclaimer, the term of this patent is extended or adjusted under 35 U.S.C. 154(b) by 127 days.

(21) Appl. No.: 16/810,515

(22) Filed: Mar. 5, 2020

(65) Prior Publication Data

US 2020/0283874 A1 Sep. 10, 2020

Related U.S. Application Data

(60) Provisional application No. 62/814,402, filed on Mar. 6, 2019.

(51) Int. Cl.
*C22C 19/05* (2006.01)

(52) U.S. Cl.
CPC ..... *C22C 19/056* (2013.01); *C22C 2200/00* (2013.01)

(58) Field of Classification Search
CPC .... C22C 19/056; C22C 30/00; C22C 2200/00
See application file for complete search history.

(56) References Cited

U.S. PATENT DOCUMENTS

| | | | | |
|---|---|---|---|---|
| 2002/0159914 | A1 | 10/2002 | Yeh | |
| 2008/0031769 | A1* | 2/2008 | Yeh | C22C 1/03 420/580 |
| 2013/0129522 | A1 | 5/2013 | Harris et al. | |
| 2014/0348689 | A1 | 11/2014 | Hardy et al. | |

* cited by examiner

*Primary Examiner* — Jessee R Roe
(74) *Attorney, Agent, or Firm* — Aaron R. Keith; Jacob A. Heafner; Michael J. Dobbs

(57) ABSTRACT

This disclosure provides alloy compositions comprising the main constituent elements iron, nickel, cobalt, molybdenum, and chromium. In one embodiment, the alloy comprises 10.0 to 30.0 wt % iron; 30.0 to 60.0 wt % nickel; 10.0 to 25.0 wt % cobalt; 1.0 to 15.0 wt % molybdenum; 15.0 to 25.0 wt % chromium by weight; where the sum of iron and nickel is at least 50 wt %; and, where the balance comprises minor elements, the total amount of minor elements being about 5% or less by weight. The alloy compositions have use as coatings to protect metals and alloys from corrosion in extreme environments where corrosion is a major concern such as with exposure to sea water or sea water with $CO_2$.

17 Claims, 8 Drawing Sheets

HIGH-PERFORMANCE CORROSION-RESISTANT HIGH-ENTROPY ALLOYS

GOVERNMENT INTEREST

The United States Government has rights in this invention pursuant to the employer-employee relationship of the Government to the inventors as U.S. Department of Energy employees and site-support contractors at the National Energy Technology Laboratory.

FIELD OF THE INVENTION

One or more embodiments consistent with the present disclosure relate to high-performance corrosion-resistant high-entropy alloys in the face-centered cubic (FCC) structure and includes materials, methods of their preparation, and methods for using the alloys described in various applications.

BACKGROUND OF THE INVENTION

Metals and alloys used in sea water, sea water with $CO_2$, or acidic aqueous environment are prone to various forms of corrosion, including pitting and/or crevice corrosion due to presence of aggressive species t, such as chlorides ($Cl^-$) in sodium chloride (NaCl). Pitting and crevice corrosion can serve as initiation sites for developing cracks that will lead to catastrophic failures of the metallic components. One current solution to this problem is to coat the metals with nickel (Ni)-based superalloys such as Hastelloy® C276; however, is very expensive. Further, poor resistance to localized corrosion in aggressive service environments leads to shortened service lifetimes. Finally, there is a need to improve the durability and ductility of the Hastelloy alloys in service.

These and other objects, aspects, and advantages of the present disclosure will become better understood with reference to the accompanying description and claims.

SUMMARY OF THE INVENTION

The present disclosure provides high entropy alloy (HEA) compositions. The alloys are characterized by a face-centered cubic (FCC) crystal structure and provide high resistance to corrosion. Additionally, the alloys feature a chemical homogeneity greater than 99%.

The alloy compositions comprise main constituent elements iron, nickel, cobalt, molybdenum, and chromium. In one embodiment, the alloy comprises 10.0 to 30.0 wt % iron; 30.0 to 60.0 wt % nickel; 10.0 to 25.0 wt % cobalt; 1.0 to 15.0 wt % molybdenum; 15.0 to 25.0 wt % chromium by weight; where the sum of iron and nickel is at least 50 wt %; and, where the balance comprises minor elements, the total amount of minor elements being about 5% or less by weight.

Besides the major metallic elements mentioned above, some other minor elements could be added into the high-entropy multielement alloys of the present disclosure. The minor elements are named "minor elements" is that the total amount of minor elements is about 1% or less by weight. In an alloy of the present invention, the minor elements can be metallic elements or nonmetallic elements. The minor metallic elements can be selected from the metallic element group consisting of lithium, beryllium, sodium, magnesium, aluminum, scandium, titanium, vanadium, manganese, copper, zinc, gallium, germanium, strontium, yttrium, zirconium, niobium, ruthenium, rhodium, palladium, silver, cadmium, indium, tin, antimony, hafnium, tantalum, tungsten, platinum, gold, lead, bismuth, lanthanum, cerium, praseodymium, neodymium, samarium, europium, gadolinium and terbium. The nonmetallic elements may be, for example, carbon, boron, silicon, phosphorus, sulfur, hydrogen, oxygen and nitrogen and so on.

The alloy compositions have use as coatings to protect metals and alloys from corrosion in extreme environments where corrosion is a major concern such as with exposure to sea water or sea water with $CO_2$. The alloys may be manufactured as bulk structural components where requirements include both high ductility and excellent corrosion resistance.

The highly corrosion resistant alloys are further demonstrated and described in the following description.

DETAILED DESCRIPTION OF THE INVENTION

Figure 1:
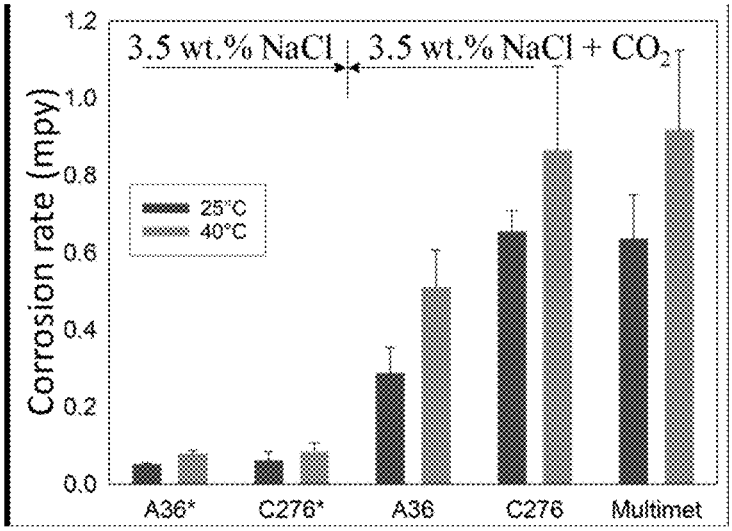
FIG. 1 depicts the corrosion rates of A36 and commercial alloys C-276 and Multimet in 3.5 wt. % NaCl solution and 3.5 wt. % NaCl solution+$CO_2$ at 25° C. and 40° C.

The following description is provided to enable any person skilled in the art to use the invention and sets forth the best mode contemplated by the inventor for carrying out the invention. Various modifications, however, will remain readily apparent to those skilled in the art, since the alloy compositions are defined herein specifically to provide highly corrosion resistant materials for use in harsh environments, methods of their preparation, and methods for using such materials.

Studies and investigations of multicomponent solid solutions in near-equal molar ratio lead to the development of high entropy alloys (HEAs), a group of alloys typically containing at least five alloying elements with an atomic composition of 5-35% each. Even though 4-component alloys are often referred to as medium entropy, within this disclosure, the alloy compositions are classified as HEAs. HEAs are also characterized by their configurational entropy of mixing ($\Delta S_{conf}$) of at least 1.5R, where R=8.314 $J \cdot mol^{-1} \cdot K^{-1}$ is the gas constant. $\Delta S_{conf}$ plays the most dominant role on the total mixing entropy, and ideal $\Delta S_{conf}$ is calculated using (1). This equation is a good approximation for liquid alloys and many solid alloys close to their solidus temperatures. $X_i$ represents the mole fraction of element i.

$$\Delta S_{conf} = -R\Sigma i(X_i \ln X_i). \quad (1)$$

High values of mixing entropy for an alloy favor the formation of single-phase solid solutions, over that of intermetallic compounds. High concentrations of multiple components offer unique physical and metallurgical properties with potential for superior mechanical, electrochemical, and magnetic characteristics suitable for applications under high-strength and high-corrosive environments such as the chemical industry, natural gas distribution systems, and marine infrastructure.

The high-entropy multielement alloy compositions of the present invention may be manufactured by using the following synthesis methods: resistance melting, induction melting, electric arc melting, rapid solidification, mechanical alloying, and powder metallurgy, etc. The technologies involved in these methods are not mentioned here since they are well known.

The high-entropy multielement alloys of the present invention are made of five major metallic elements. The major metallic elements in the alloy include iron, nickel, cobalt, molybdenum, and chromium. By wt %, the alloys comprise 10.0 to 30.0 wt % iron, 30.0 to 60.0 wt % nickel, 10.0 to 25.0 wt % cobalt, 1.0 to 15.0 wt % molybdenum, and 15.0 to 25.0 wt % chromium, where the sum of iron and nickel wt % is at least 50 wt %; and, where the balance comprises minor elements, the total amount of minor elements being about 5% or less by weight. In one embodiment, the alloys comprise 16.0 to 25.0 wt % iron, 35.0 to 50.0 wt % nickel, 15.0 to 20.0 wt % cobalt, 5.0 to 10.0 wt % molybdenum, and 15.0 to 20.0 wt % chromium where the sum of iron and nickel wt % is at least 50 wt %; and, where the balance comprises minor elements, the total amount of minor elements being about 5% or less by weight. In one embodiment, the alloy composition is $CoCrFeNi_2Mo_{0.25}$. The balance of the alloy composition comprises minor elements, the total amount of minor elements being about 5% by weight or less. In one embodiment, the balance of the alloy composition comprises minor elements, the total amount of minor elements being about 1% by weight or less.

As noted above, aside the major metallic elements mentioned above, some other minor elements, the total amount of minor elements being about 5% or less by weight, may be added into the high-entropy multielement alloys of the present invention. The minor elements can be metallic or nonmetallic. The minor metallic elements can be lithium, beryllium, sodium, magnesium, aluminum, scandium, titanium, vanadium, manganese, copper, zinc, gallium, germanium, strontium, yttrium, zirconium, niobium, ruthenium, rhodium, palladium, silver, cadmium, indium, tin, antimony, hafnium, tantalum, tungsten, platinum, gold, lead, bismuth, lanthanum, cerium, praseodymium, neodymium, samarium, europium, gadolinium and terbium.

The minor nonmetallic elements can be carbon, boron, silicon, phosphorus, sulfur, oxygen and nitrogen. Notably, the minor elements ay be defined as comprising less than about 5 wt % for each of the minor element constituents. In one embodiment, the minor elements comprise less than about 1000 parts per million oxygen, 1000 parts per million nitrogen, 1000 parts per million carbon, and 150 parts per million sulfur. In another embodiment, the minor elements comprise less than about 500 parts per million oxygen, 500 parts per million nitrogen, 500 parts per million carbon, and 20 parts per million sulfur Each of the claimed alloy compositions has a face centered cubic (FCC) crystal structure. Additionally, each of the claimed alloy compositions provides an ASTM grain size in a range from about 3 to about 20. In one embodiment, the alloy compositions provide an ASTM grain size in a range from about 8 to about 12. In one embodiment, the alloy compositions have a residual inhomogeneity of the corrosion resistant alloy is less than 10%. In another embodiment, the alloy compositions have a residual inhomogeneity of the corrosion resistant alloy is less than 10%.

Additionally, the claimed alloy compositions provide a corrosion rate (CR) of less than 0.050 mils per year(mpy) in 3.5 wt. % NaCl at 25° C. CR is determined by $CR=(I_{corr}\cdot K\cdot EW)/(d\cdot A)$ where $I_{corr}$ is the corrosion current in amperes and calculated using the Tafel extrapolation method where the cathodic reaction is diffusion controlled; K is a constant equal to 3.27×103 with units of mm/y; the equivalent weight (EW) is a dimensionless unit that represents the mass of the metal species that will react with one Faraday of charge; d is the density of the metal in $g/cm^3$; and A is the area exposed to corrosion.

EXAMPLES

The alloy composition of the present disclosure $CoCrFeNi_2Mo_{0.25}$ (A36) was investigated along with the Mo lacking alloy $CoCrFeNi_2$ (A35) and the three commercial alloys, HASTELLOY C-276 (UNS N10276), d stainless steel 316L (UNS 31600) and Multimet (UNS R30155).

The alloy compositions have a face-centered cubic (FCC) crystal structure based on 3d transition metals. The passive elements such as Cr and Mo add high mixing entropy and low free energy, aspects that benefit the corrosion resistance of alloys. The corrosion behavior of these alloys was evaluated via electrochemical methods by carrying out experiments in 3.5 wt. % NaCl solution, simulating artificial seawater at room temperature (25° C.). Table 1 shows the alloy composition, ASTM grain size, and configurational entropy. Table 2 and FIG. 1 show electrochemical parameters ($E_{corr}$), corrosion current density ($i_{corr}$), breakdown potential (E) and the resulting corrosion rate (CR).

TABLE 1

Alloy compositions, grain size, and configurational entropy.

| | Wt. % | | | | | | Ppm | | | | | ASTM grain | |
|---|---|---|---|---|---|---|---|---|---|---|---|---|---|
| Alloy | Fe | Ni | Co | Mo | Cr | Other | Other | O | N | C | S | size | $\Delta S_{conf}$ |
| A36 | 18.46 | 37.81 | 18.99 | 7.64 | 16.95 | | | 4 | 9 | 160 | 10 | 4 | 1.5 R |
| A35 | 19.98 | 40.84 | 20.67 | — | 18.4 | | | 11 | 11 | 165 | 10 | 6 | 1.3 R |
| C-276 | 5.5 | 57 | 2.5 | 16 | 15.5 | 4.00 W<br>1.00 Mn | 800 Si<br>3500 V | | | 100 | | 5 | 1.4 R |
| SS316 | 68.59 | 10.47 | 0.21 | 2 | 16.61 | 0.35 Cu<br>1.39 Mn | 310 P<br>2500 Si | | 536 | 178 | 200 | 7 | 1.0 R |

TABLE 2

Electrochemical parameters for HEAs A36 and A35 and commercial alloys C-276 and SS316 in 3.5 wt. % NaCl solution at 25° C.

| Alloy | $E_{corr}$ (V vs. SCE) | $E_{bre}$ (V vs. SCE) | $i_{corr}$ ($\times 10^{-7}$ A/cm$^2$) | CR (mpy) |
|---|---|---|---|---|
| A36 | −0.26 | 0.91 | 1.25 | 0.048 |
| A35 | −0.29 | 0.32 | 1.29 | 0.052 |
| C-276 | −0.28 | 0.74 | 1.28 | 0.056 |
| SS316 | −0.25 | 0.27 | 1.11 | 0.049 |

A combination of commercial purity starting materials and in-house refined Ni—Co—Cr master alloys were used to formulate alloys A35 and A36 with the nominal chemistries shown in Table 1 using a starting weight of approximately 8000 g. Each alloy was induction-melted under inert gas and poured with a 50° C. superheat into a 75 mm cylindrical graphite mold having a nonreactive ceramic wash coat. After casting, the hot-tops of each ingot were removed with a band saw, and a 2 mm thick slice was used for chemical analysis. Each ingot was given a computationally optimized homogenization heat treatment to reduce the inhomogeneity to ±1% of nominal or better. The sidewalls of the ingots were conditioned on a lathe, and the ingots were bagged in protective stainless-steel foil pouches and preheated for 3 hours prior to fabrication. Alloy A35 was hot worked at 900° C. while alloy A36 was hot worked at 1100° C. due to the more refractory nature of the alloy. Hot working consisted of forging and rolling to reduce the round ingots into slab shapes, which were ultimately formed into strip product with a thickness of approximately 3.7 mm.

Figure 2A:
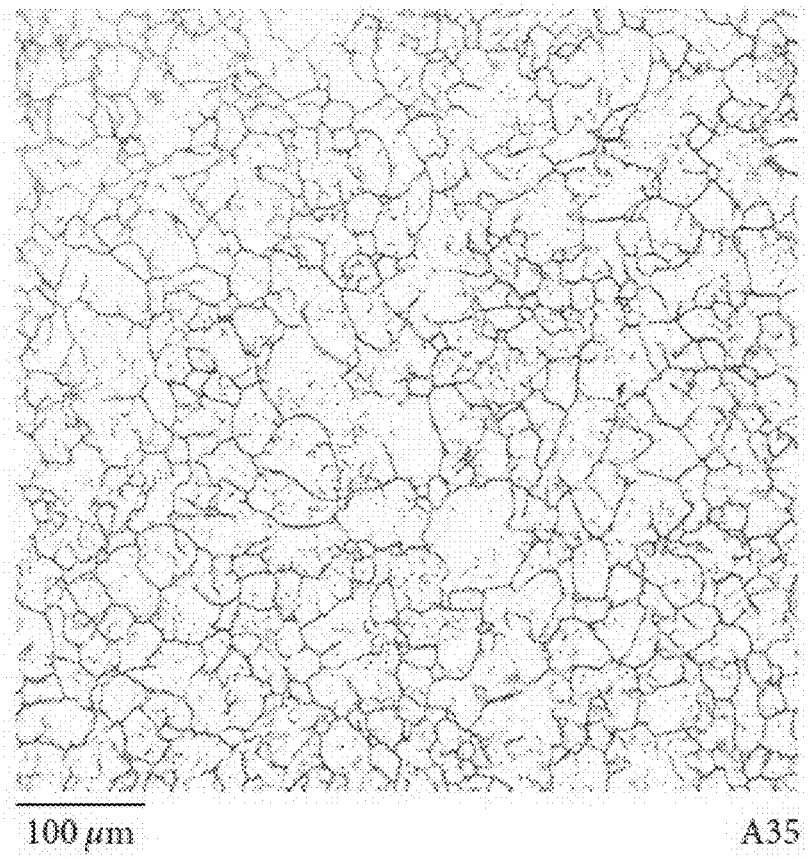
FIG. 2(*a*) depicts a micrograph of the as-cast alloy A35 and FIG. 2(*b*) depicts a micrograph of the as-cast alloy A36.
Figure 2B:
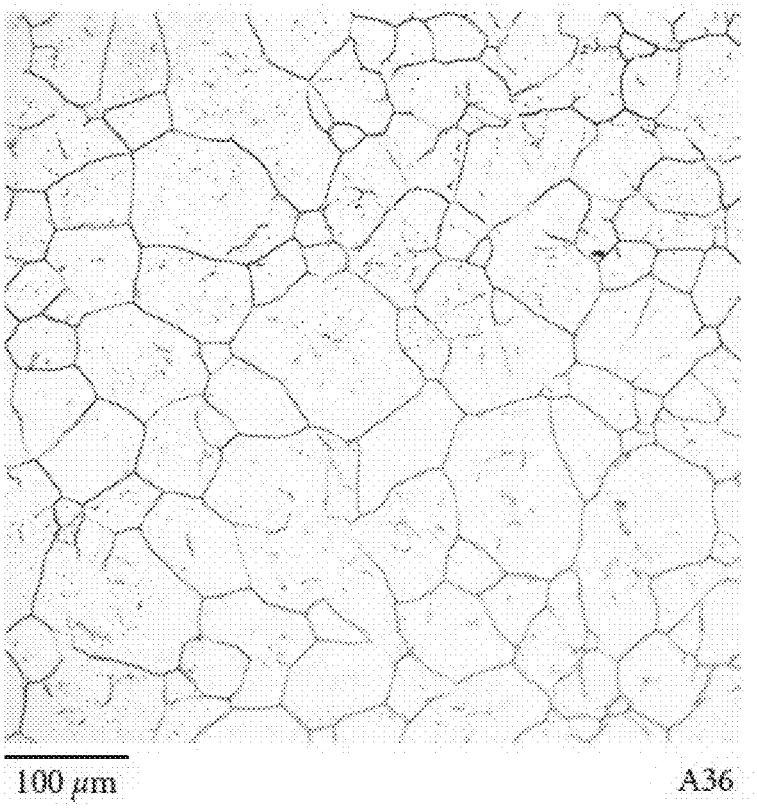
Figure 3A:
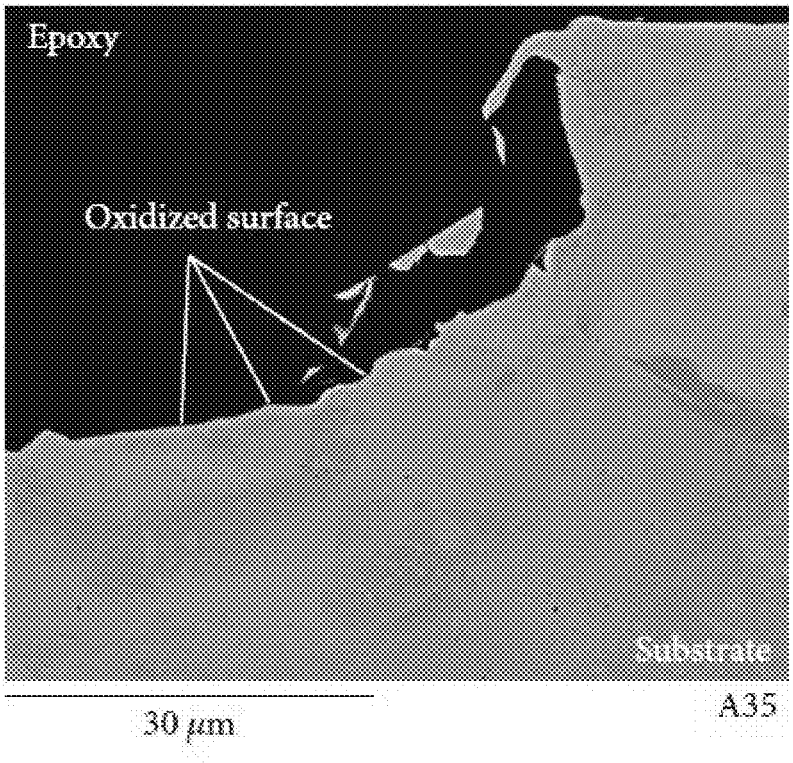
FIG. 3(*a*) depicts a SEM micrographs of alloy A35 after potentiodynamic polarization experiments (cross sections) and FIG. 3(*b*) depicts a SEM micrographs of alloy A36 after potentiodynamic polarization experiments (cross sections).
Figure 3B:
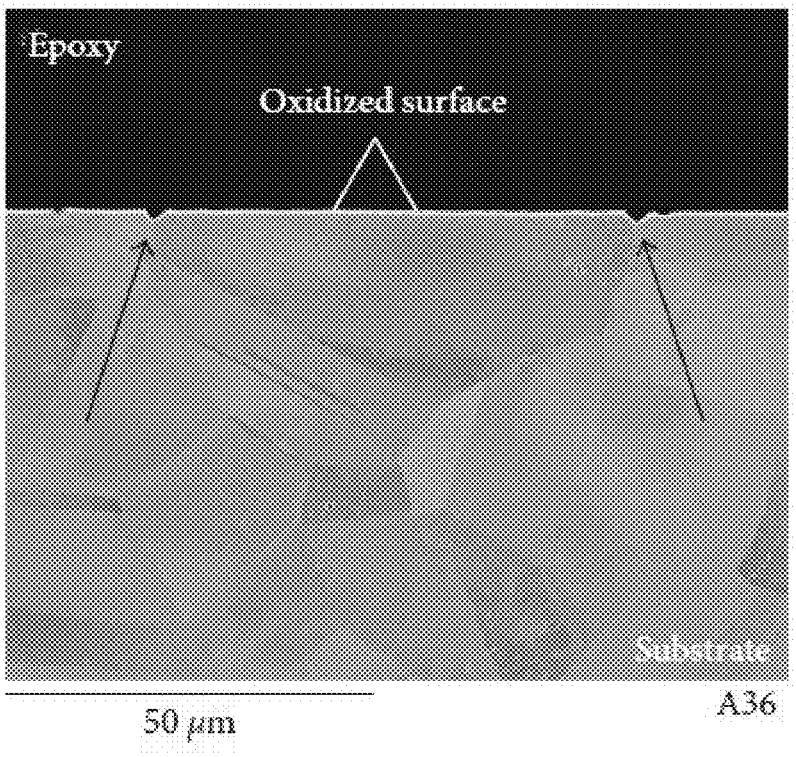

Microstructure Characterization:

The average grain size for the microstructure of alloys A35 and A36 was 40 μm (std. dev.: 4.8) and 86 μm (std. dev.: 7.5), respectively, as determined using the linear intersect technique on images presented in FIG. 2(*a*) (A35) and FIG. 2(*b*) (A36). The size difference of the grain is attributed to the hot working process of A35 (900° C.) versus A36 (1100° C.). The optical micrographs reveal an equiaxed grain structure indicating full recrystallization during the forging and rolling processes. Furthermore, SEM observation at higher magnifications revealed a single-phase microstructure with only small inclusions from casting. No μphase was observed. SEM images of the cross section of samples A35 and A36 can be seen in FIGS. 3(*a*) and (*b*), respectively, where the formation of a protective passive layer along the grain boundaries of alloy A36 (also seen in FIGS. 4(*d*) and 4(*e*)) confirms the effect of grain size on the corrosion resistance of this alloy after electrochemical polarization experiments.

Figure 4:
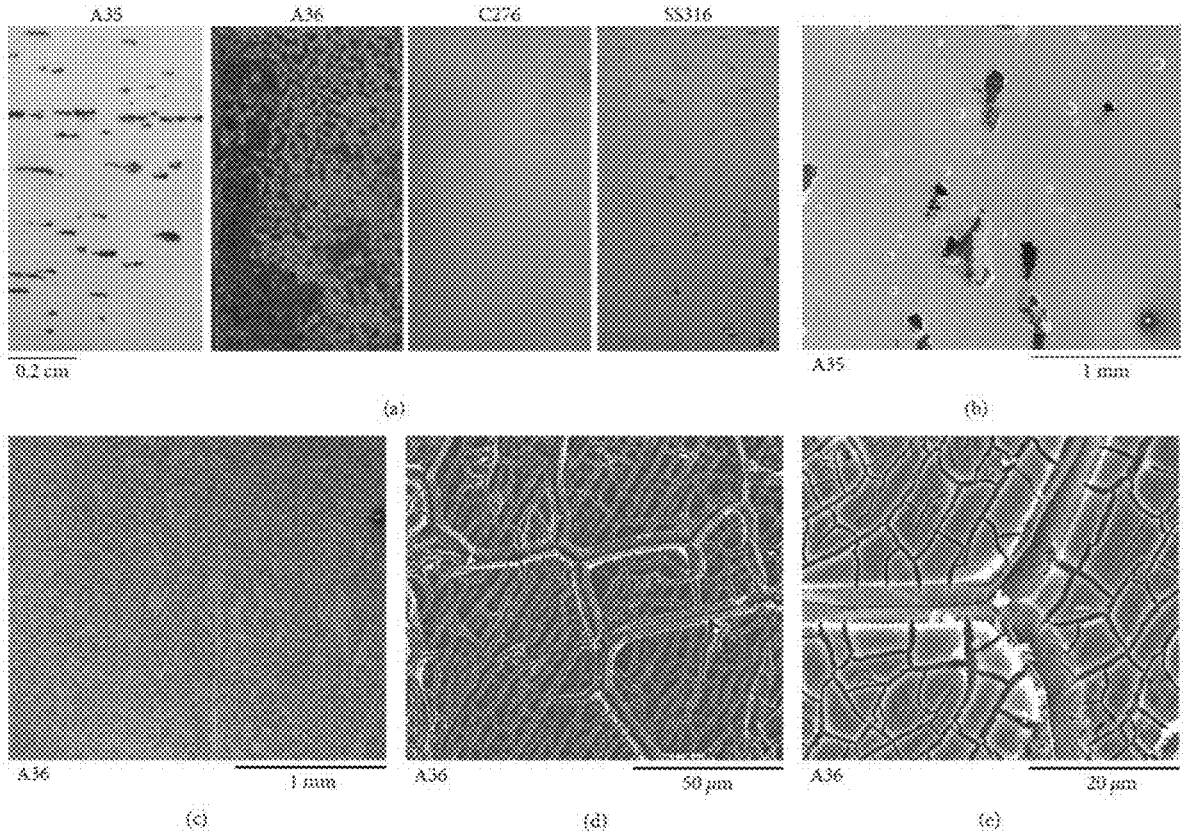
FIG. 4 depicts SEM images (a) A36, A35 and (b,c) commercial alloys C-276 and SS316 at different magnifications for (d, e) A35 and A36 at different magnifications of A36 after the anodic polarization experiment in 3.5 wt. % NaCl solution at 25° C.

Electrochemical Testing:

Potentiodynamic polarization curves of all specimens are shown in FIG. 4. A35 and A36 and commercial alloys C-276 and SS316 do not exhibit an anodic active region represented by a straight potential-current line in 3.5 wt. % NaCl. However, the cathodic reaction seen as a straight line indicates electron-transfer control. All the alloys show passive regions making them less susceptible to general corrosion. A35 exhibits a passive region with a breakdown potential of 0.32V versus standard calomel electrode (SCE) where metastable pitting starts occurring. A36 displays the highest breakdown potential at 0.91V versus SCE, making it less susceptible to localized corrosion. Alloy C-276 exhibits three regions, a passive region with a breakdown potential of 0.74V versus SCE, a trans-passive region, and a secondary passive region with a potential of 1.12V versus SCE. Finally, alloy SS316 had the lowest breakdown potential (0.27V versus SCE) of all evaluated materials The NaCl solution had an initial pH of 8.4 before potentiodynamic polarization experiments were carried out. Final pH of the solution was measured as 10.9 for A35 and 10.1 for A36. A35 underwent passivation between its corrosion potential ($E_{corr}$) of −0.29V versus SCE (−0.05 versus standard hydrogen electrode (SHE)) and its breakdown potential ($E_{corr}$) of 0.32V versus SCE (0.56V versus SHE). At these potentials, Co, Fe, and Ni are active species while Cr is passive. The passivation of the alloy is caused by the formation of a stable chromium oxide layer on the surface in the form of $2Cr+3H_2O=2Cr_2O_3+6H^++6e^-$. The breakdown of this oxide layer is the first step in the localized damage of this protective layer by the chemical attack of aggressive species such as chlorides. The oxide film is locally attacked $Cr_2O_3+5H_2O=2CrO_2^{-4}+10H^++6e^-$ at weak spots, where inclusions or mechanical flaws permit the transport of ions (accelerated by chloride ions) at these sites forming anodic active behavior.

The passive area of alloy A36 lies between its $E_{corr}$ of −0.26V versus SCE (−0.02 versus SHE) and $E_{bre}$ of 0.91V versus SCE (1.15V versus SHE). Co, Fe, and Ni are active species at these potentials while Cr and Mo are passive. In addition to the formation of a layer of chromium oxide ($Cr_2O_3$), responsible for the passive behavior, Mo increases the stability of the protective layer and enhances $E_{bre}$ by precipitation of Mo species on the surface at pH values higher than 8.0 ($Mo+2H_2O=MoO_2+4H^++4e^-$. As it was discussed for alloy A35, Ni, Fe, and Co species preferentially dissolve in solution. This corrosion mechanism further contributes to Mo enrichment on alloy A36 surface leading to greater corrosion resistance properties.

Figure 5:
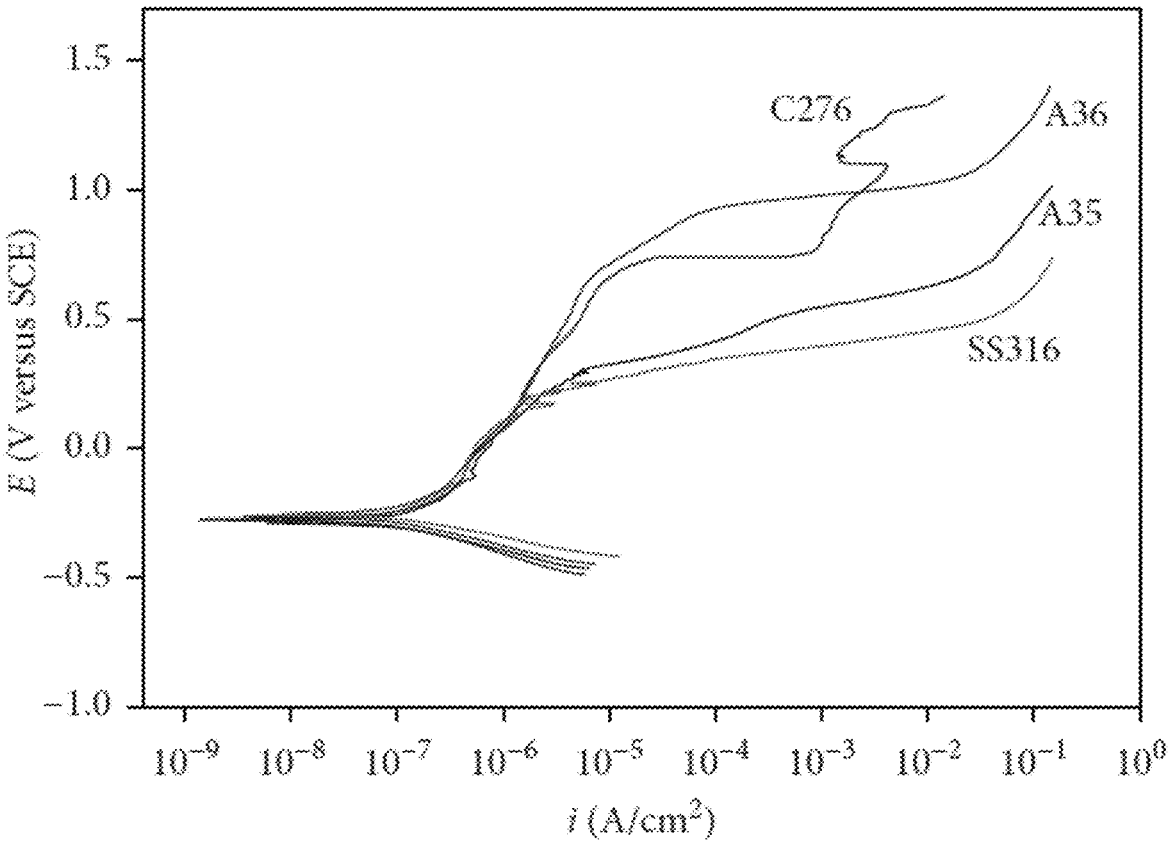
FIG. 5 depicts potentiodynamic polarization curves of A35 and A36 and commercial alloys C-276 and SS316 in 3.5 wt. % NaCl solution saturated at 25° C.

Localized attack in the form of pitting corrosion was seen in A35 and SS316 after potentiodynamic polarization tests (FIG. 5). The average pit size diameter and pitting density % per 1 cm$^2$ for A35 and SS316 are 0.19 μm (6.2%) and 0.03 μm (7.7%), respectively. In contrast, A36 and C-276 developed the formation of a passive film due to a high breakdown potential, increasing resistance to pitting or crevice corrosion. Even though chromium content promotes the formation of this passive film in aqueous solutions under potentiodynamic polarization, film stability increases with the content of molybdenum.

The SEM images revealed large pitting corrosion evolution in sample A35 (FIG. 4(*b*)) and the formation of an inner amorphous corrosion layer in sample A36 (FIG. 4(*c*)). The fine scale channels in FIGS. 4(*d*) and 4(*e*) (cracking of the inner amorphous corrosion layer) are attributed to the dehydration effect during sample storage. However, the larger channels most likely follow the grain boundaries (arrows in FIG. 3(*b*)).

Figure 6:
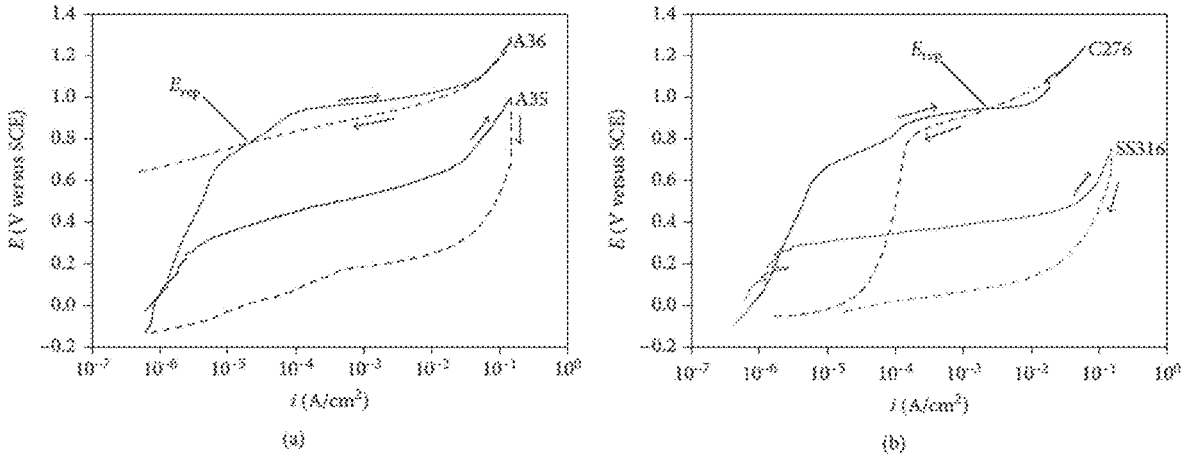
FIG. 6 depicts cyclic anodic polarization curves of A35, A36, C-276, and SS316 alloys in 3.5 wt. % NaCl solution at 25° C.

Cyclic anodic polarization curves of A35, A36, C-276, and SS316 alloys are shown in FIG. 6. The behavior of the potential at which the hysteresis loop is completed upon reverse polarization scan determines the susceptibility to the initiation of localized corrosion. Although all alloys display hysteresis under this high anodic polarization, A36 and C-276 have significantly higher Ebre and repassivation potentials (Erep) than the A35 and SS316 alloys. Consequently, A36 and C-276 are relatively more resistant to pitting corrosion than A35 and SS316 in this environment, due mainly to a small potential difference between $E_{rep}$ and $E_{bre}$.

Results:

The electrochemical behavior of the alloys is affected by changes in grain refinement. Finer grain size of alloy A35 presented an increase of weak spots for pitting initiation at preferential sites. On the other hand, alloy A36 formed a protective passive layer along the grain boundaries contributing to higher corrosion resistance.

Potentiodynamic polarization results indicated that chloride ions adsorb on the metal surface of alloys A35 and SS316, breaking down passivity. The attack of this passivity is localized and favors the formation of pits, seen during microscopic imaging analysis. The pit size diameter observed on A35 and SS316 was 0.19 μm and 0.03 μm, respectively. A higher content of molybdenum in SS316 may result in a better stability of the passive layer compared to A35.

In the case of alloys A36 and C-276, potentiodynamic polarization results indicated that both passivate in NaCl forming a protective layer against pitting corrosion. Microscopic investigations revealed no formation of pits and a cracked film on the surface of alloy A36, due to a possible film dehydration effect after electrochemical experiments.

Alloy A35 underwent passation between its $E_{corr}$ of −0.29 V versus SCE (−0.05 versus SHE) and its $E_{bre}$ of 0.32 V versus SCE (0.56V versus SHE). Passivation of the alloy is caused by the formation of $Cr_2O_3$, yet chemical attack of chlorides initiates breakdown of this oxide layer and initiation of pitting corrosion. Ni acts as the cathode on the galvanic couple Ni—Co and Ni—Fe, where Ni species dissolve and precipitate in solution by hydrolysis. Thus, higher concentration of Ni favors corrosion of Fe and Co species.

The passive area of alloy A36 lies between its $E_{corr}$ of −0.26V vesus SCE (−0.02 versus SHE) and $E_{bre}$ of 0.91V versus SCE (1.15V versus SHE). In addition to the formation of a layer of $Cr_2O_3$, responsible for the passive behavior, Mo increases the stability of the protective layer and enhances $E_{bre}$ by precipitation of $MoO_2$ on the surface at pH values higher than 8.0. Transpassivity of Mo occurs by further oxidation at higher potentials: $MoO_2+2H_2O=MoO^2{}_{-4}4H^{+}+2e^{-}$. As it was discussed for alloy A35, Ni, Fe, and Co species preferentially dissolve in solution to further contribute to Mo enrichment on alloy A36 surface leading to greater corrosion resistance properties.

The results obtained from cyclic polarization experiments revealed large hysteresis and less electropositive potentials for alloys A35 and SS316, indicating the susceptibility of pitting corrosion. Alloys A36 and C-276 developed a passive layer during potentiodynamic polarization and exhibited a small potential difference between $E_{rep}$ and $E_{bre}$, making them more resistant to pitting corrosion in NaCl.

Electrochemical impedance spectroscopy results indicate that alloy C-276 had the highest charge transfer value at the metal/electrolyte interface. This charge transfer parameter represents favorable characteristics of the passive film and consequently higher corrosion resistance due to its passivation ability in NaCl.

The role of molybdenum on the corrosion performance of HEAs A35 and A36 demonstrated its influence on the passivation ability of A36 by (1) providing a corrosion protective layer and (2) avoiding the evolution of pitting corrosion. The formation and stability of this passive layer was highly influenced by Mo content in C-276 (16 wt. % versus 7.64 wt % in A36).

Having described the basic concept of the embodiments, it will be apparent to those skilled in the art that the foregoing detailed disclosure is intended to be presented by way of example. Accordingly, these terms should be interpreted as indicating that insubstantial or inconsequential modifications or alterations and various improvements of the subject matter described and claimed are considered to be within the scope of the spirited embodiments as recited in the appended claims. Additionally, the recited order of the elements or sequences, or the use of numbers, letters or other designations therefor, is not intended to limit the claimed processes to any order except as may be specified. All ranges disclosed herein also encompass any and all possible sub-ranges and combinations of sub-ranges thereof. Any listed range is easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as up to, at least, greater than, less than, and the like refer to ranges which are subsequently broken down into sub-ranges as discussed above. As utilized herein, the terms "about," "substantially," and other similar terms are intended to have a broad meaning in conjunction with the common and accepted usage by those having ordinary skill in the art to which the subject matter of this disclosure pertains. As utilized herein, the term "approximately equal to" shall carry the meaning of being within 15, 10, 5, 4, 3, 2, or 1 percent of the subject measurement, item, unit, or concentration, with preference given to the percent variance. It should be understood by those of skill in the art who review this disclosure that these terms are intended to allow a description of certain features described and claimed without restricting the scope of these features to the exact numerical ranges provided. Accordingly, the embodiments are limited only by the following claims and equivalents thereto. All publications and patent documents cited in this application are incorporated by reference in their entirety for all purposes to the same extent as if each individual publication or patent document were so individually denoted.

We claim:

1. A corrosion resistant alloy composition comprising:
10.0 to 30.0 wt % iron;
30.0 to 60.0 wt % nickel;
10.0 to 25.0 wt % cobalt;
1.0 to 15.0 wt % molybdenum;
15.0 to 25.0 wt % chromium;
where the sum of iron and nickel is at least 50 wt %; and,
where the balance comprises minor elements, the total amount of minor elements being about 5% or less by weight, and where the ASTM grain size is in a range from about 3 to about 20.

2. The alloy composition of claim 1, where the alloy has an FCC crystal structure.

3. The alloy composition of claim 1, where the minor elements comprise less than about 1000 parts per million oxygen, 1000 parts per million nitrogen, 1000 parts per million carbon, and 150 parts per million sulfur.

4. The alloy composition of claim 1, where the ASTM grain size is in a range from about 8 to about 12.

5. The alloy composition of claim 1, where the corrosion rate is less than 0.050 mils per year in 3.5% sodium chloride.

6. The alloy composition of claim 1, where the residual inhomogeneity of the corrosion resistant alloy is less than 10%.

7. The alloy composition of claim 1, where the alloy comprises:
16.0 to 25.0 wt % iron;
35.0 to 50.0 wt % nickel;
15.0 to 20.0 wt % cobalt;
5.0 to 10.0 wt % molybdenum; and,
15.0 to 20.0 wt % chromium.

8. The alloy composition of claim 1, where alloy composition comprises 18.46 wt % iron;

37.81 wt % nickel;

18.99 wt % cobalt;

7.64 wt % molybdenum by weight;

16.95 wt % chromium by weight;

the balance comprising minor elements 4 parts per million oxygen, 9 parts per million nitrogen, 160 parts per million carbon, and 10 parts per million sulfur, and where the ASTM grain size is 4.

9. A corrosion resistant alloy composition comprising:

10.0 to 30.0 wt % iron;

30.0 to 60.0 wt % nickel;

10.0 to 25.0 wt % cobalt;

1.0 to 15.0 wt % molybdenum;

10.0 to 25.0 wt % chromium;

where the sum of iron and nickel is at least 50 wt %; and, where the balance comprises minor elements, the total amount of minor elements being about 5% or less by weight, and where the ASTM grain size is in a range from about 8 to about 12.

10. The alloy composition of claim 9, where the minor elements comprise less than about 500 parts per million oxygen, 500 parts per million nitrogen, 500 parts per million carbon, and 20 parts per million sulfur.

11. The alloy composition of claim 9, where the alloy has an FCC crystal structure.

12. The alloy composition of claim 9, where the minor elements comprise less than about 1000 parts per million oxygen, 1000 parts per million nitrogen, 1000 parts per million carbon, and 150 parts per million sulfur.

13. The alloy composition of claim 9, where the minor elements comprise less than about 500 parts per million oxygen, 500 parts per million nitrogen, 500 parts per million carbon, and 20 parts per million sulfur.

14. The alloy composition of claim 9, where the corrosion rate is less than 0.050 mils per year in 3.5% sodium chloride.

15. The alloy composition of claim 9, where the residual inhomogeneity of the corrosion resistant alloy is less than 10%.

16. The alloy composition of claim 9, where the alloy comprises:

16.0 to 25.0 wt % iron;

35.0 to 50.0 wt % nickel;

15.0 to 20.0 wt % cobalt;

5.0 to 10.0 wt % molybdenum; and, 15.0 to 20.0 wt % chromium.

17. A corrosion resistant alloy composition comprising:

18.46 wt % iron;

37.81 wt % nickel;

18.99 wt % cobalt;

7.64 wt % molybdenum by weight;

16.95 wt % chromium by weight;

the balance comprising minor elements 4 parts per million oxygen, 9 parts per million nitrogen, 160 parts per million carbon, and 10 parts per million sulfur, and where the ASTM grain size is 4.

* * * * *